US010391623B2

(12) United States Patent
Pedersen

(10) Patent No.: US 10,391,623 B2
(45) Date of Patent: Aug. 27, 2019

(54) POWER TOOL

(75) Inventor: Troels Pedersen, Niva (DK)

(73) Assignee: Hilti Aktiengesellschaft, Schaan (LI)

( * ) Notice: Subject to any disclaimer, the term of this patent is extended or adjusted under 35 U.S.C. 154(b) by 1814 days.

(21) Appl. No.: 13/695,028

(22) PCT Filed: Apr. 29, 2011

(86) PCT No.: PCT/EP2011/056844

§ 371 (c)(1),
(2), (4) Date: Jan. 22, 2013

(87) PCT Pub. No.: WO2011/135076

PCT Pub. Date: Nov. 3, 2011

(65) Prior Publication Data

US 2013/0105186 A1 May 2, 2013

(30) Foreign Application Priority Data

Apr. 29, 2010 (DK) ..... 2010 70179

(51) Int. Cl.
*B25F 5/00* (2006.01)

(52) U.S. Cl.
CPC ..... *B25F 5/001* (2013.01)

(58) Field of Classification Search
CPC ..... B25B 15/04; B25B 13/46; B25B 13/461–13/468
USPC ..... 173/47; 81/57.22
See application file for complete search history.

(56) References Cited

U.S. PATENT DOCUMENTS 3,329,185 A * 7/1967 Hettich ..... B25B 21/00 173/217
3,802,518 A * 4/1974 Albert ..... B25B 13/46 173/217
4,364,286 A * 12/1982 Ciolli ..... B25F 5/001 188/134
4,448,098 A * 5/1984 Totsu ..... B25B 15/04 81/467
5,328,419 A 7/1994 Motl et al.
5,967,934 A 10/1999 Ishida et al.
6,273,200 B1 * 8/2001 Smith ..... B25B 21/00 173/216
6,796,921 B1 9/2004 Buck et al.
7,588,398 B2 * 9/2009 Puzio ..... B23B 31/1253 279/135

(Continued)

FOREIGN PATENT DOCUMENTS

CN 1527913 9/2004
CN 1583370 2/2005

(Continued)

*Primary Examiner* — Andrew M Tecco
(74) *Attorney, Agent, or Firm* — Davidson, Davidson & Kappel, LLC

(57) ABSTRACT

A power tool with an epicyclically or so called planet gear system with two annulus gears, at least one solar gear with external toothing, and planet wheels having two toothed rings which each mesh with one of the annulus gears. A planet carrier holding the planet wheels. The gear is interchangeable between an at least first configuration and second configuration, wherein the planet carrier is interchangeable between being locked or partly locked rotationally to the frame or being unlocked rotationally from the frame.

15 Claims, 5 Drawing Sheets

(56) References Cited

U.S. PATENT DOCUMENTS

| | | | | |
|---|---|---|---|---|
| 7,963,195 | B2 * | 6/2011 | McRoberts | B25B 13/465 81/54 |
| 8,205,685 | B2 * | 6/2012 | Bixler | B25F 5/001 173/176 |
| 8,397,831 | B2 * | 3/2013 | Wan | B25B 13/463 173/29 |
| 2002/0119860 | A1 | 8/2002 | Strong et al. | |
| 2003/0171185 | A1 | 9/2003 | Potter et al. | |
| 2004/0142787 | A1 | 7/2004 | Milbourne et al. | |
| 2004/0211576 | A1 | 10/2004 | Milbourne et al. | |
| 2005/0043135 | A1 | 2/2005 | Potter et al. | |
| 2005/0215385 | A1 | 9/2005 | Spielmann et al. | |
| 2007/0023196 | A1 | 2/2007 | Hara et al. | |
| 2007/0201748 | A1 * | 8/2007 | Bixler | B25F 5/001 382/225 |
| 2009/0071673 | A1 | 3/2009 | Zhong et al. | |
| 2010/0071922 | A1 * | 3/2010 | Wan | B25B 21/00 173/47 |
| 2011/0214891 | A1 | 9/2011 | Roehm | |

FOREIGN PATENT DOCUMENTS

| | | |
|---|---|---|
| CN | 2808721 | 8/2006 |
| EP | 2 095 909 | 9/2009 |
| GB | 476160 A | 11/1937 |
| GB | 2 335 011 | 9/1999 |
| JP | 2009-72903 | 4/2009 |
| JP | 2009125909 | 6/2009 |
| WO | WO 2009/027821 | 3/2009 |
| WO | WO2009/027821 | 3/2009 |
| WO | WO 2010/034563 | 4/2010 |

* cited by examiner

POWER TOOL

The present invention relates to a power tool with a gear which is controllable and thereby provides changes in the mechanical advantage between an input and an output shaft, in the following referred to as a gear system or a gear train.

In particular, the invention relates to a power tool comprising a frame, a motor, a rotor which can be rotated relative to the frame by the motor and which can manipulate a tool, and a transmission for transmitting power between the motor and the rotor. The transmission comprises: —at least a primary and a secondary internally driven annulus gear, an externally driven sun gear, a planet carrier, and at least one planet wheel carried by the planet carrier and arranged to transfer torque between the sun gear and one of the annulus gears, wherein each annulus gear, the sun gear and the planet carrier can rotate concentrically around a central axis, each planet wheel can rotate epicyclically around the central axis, and each planet wheel comprises at least two concentrically joined gear wheels.

BACKGROUND

Power tools such as drills, grinders, cutters, hammers, sanders, pressure washers, foam guns, routers, hole diggers, and winches etc, typically comprises a motor which transfers torque to a tool via a transmission. Often, the transmission includes a gear. Planet gearing is sometimes referred to as "Epicyclic gearing" and describes a gear system with a housing comprising one or more planet wheels rotating about a centrally located sun gear. Sometimes, the planet wheels are mounted on a movable carrier. The carrier may either be fixed relative to the housing, or it may rotate relative to the housing and/or relative to the sun gear.

The gear system may further incorporate an outer ring gear with radially inwardly projecting gear teeth, generally referred to as the annulus. The annulus meshes with the planet wheels and at least one of the planet wheels again mesh with the sun gear.

There are several ways in which an input rotation can be converted into an output rotation. In general, one of the above mentioned basic components, i.e. the sun, the carrier or the annulus, is held stationary; one of the two remaining components is an input, providing power to the system, while the last component is an output, receiving power from the system.

The ratio of input rotation to output rotation depends upon the number of teeth in each gear included in the system and depends further upon which component is held stationary. When e.g. the carrier is held stationary, and the sun gear is used as input, the planet wheels simply rotate about their own axes at a rate determined by the number of teeth in each gear. If the sun gear has S teeth, and each planet wheel has P teeth, the ratio is equal to S/P. If the annulus has A teeth, the planet wheels drive the annulus in a ratio of P/A turns for each turn of the planet wheels.

In one implementation of a planet gear system, the annulus is held stationary and the sun gear is used as the input. This provides the lowest gear ratio, i.e. $1/(1+A/S)$, attainable with a planet gear train.

In the gear system mentioned in the introduction, the double-ring planet gear, i.e. the planet wheels with at least two concentrically joined gear wheels, comprises a first gear ring which is integral with a second gear ring and the primary and secondary annulus gears are typically formed internally in disc shaped gear members which thereby form housing for the gear system. This gear system offers a particularly low gear ratio at relatively small outer dimensions of the gear system and it is therefore applied in mechanical system with narrow space, e.g. for electrical operation of a rear-view mirror in a vehicle.

Often, power tools are provided with a gear mechanism which can either change between different gear ratios or which can release and thus prevent transmission of torque at a specific counter torque, i.e. the function known from a torque wrench etc. In traditional transmission systems, the rotor rotation is normally limited or stopped by a key which locks the output of the gearbox directly to the rotor when stopping of the rotor is intended. This is typically seen as a safety feature which prevents undesired rotation of the rotor when the tool is stopped. The traditional way of locking the output directly to the rotor is a common feature in many handheld grinders etc. Consequently the key needs to be able to withstand the entire torque applied to or by the rotor. This increases the demands for mechanical strength in the transmission and braking system thus increases costs, weight, and dimensions of the power tool—features which are very essential particular with regards to hand-held power tools. A traditional solution within servo systems and other non-power tool related applications to limit or stop rotation of the rotor by braking is to connect the input shaft of the gearbox to the frame, so that the advantage of the full gear ratio helps in stopping or limiting the rotor rotation, i.e. the torque conversion helps in braking the rotor, and the braking system therefore need not to be as strong as required in traditional power tools. This solution, however, is complicated in relation to a power tool, where it is typically desired to have the transmission as one unit being separate from the motor, and where the motor is typically a low cost standard motor without braking means.

SUMMARY OF THE INVENTION

It is an object of the invention to provide a tool with an improved gear system which facilitates shifting between different gear ratios or change in direction of rotation. It is particularly an object to provide a shifting feature without increasing the size and complexity of the transmission. It is a further object of the invention to provide a tool with a transmission which provides a torque release mechanism in a very simple and reliable manner, again essentially without increasing the size of the transmission. It is a further object to provide a power tool with enhanced rotor limitation or safety braking facilities which potentially may reduce the weight, complexity, and cost of the power tool.

The present invention provides a power tool with a gear system, i.e. a train of meshed gears as mentioned in the introduction being changeable between a first configuration in which power is transmitted between the input shaft and the output shaft via shifting between at least two configurations, e.g. depending on the operation of the power tool, i.e. e.g. depending on a torque acting on the power tool. In a first configuration where the planet carrier is fixed or partly fixed to the frame and a second configuration where the planet carrier is allowed to freely rotate without being limited by a connection to the frame.

Since the configuration is changed by the planet carrier which is either free to rotate or limited by contact with the frame, the transmission becomes very simple compared to known transmissions and the outer dimensions of the transmission can be reduced.

Compared with the traditional tools where the rotor is locked directly to the output of the transmission by use of a key, the invention, by connecting or releasing the carrier from the frame reduces the torque which acts on the components of the transmission and thus reduces the necessary strength and thus dimensions of the transmission and of the braking system and thus the costs and weight of the power tool.

Accordingly, the feature of limiting the rotation of the carrier, or even locking the carrier to the frame is highly advantageous, as this besides from giving a safety feature of efficiently braking the rotor via the planet carrier, also may act as part of a gear ratio change system. Particularly in relation to power tools, the invention therefore optimises the mechanical system by providing several features in one and the same gear change structure and by selecting that the gear change structure operates on the carrier.

In addition, the introduction of such a limiting or locking device for the carrier is very easy implemented on the carrier and compared with the solution being common in non power tool related systems where the braking structure operates on the input shaft, the claimed solution is advantageous for power tools since it is much easier to access the carrier without having to select braking motors of very specific kinds.

The power tool could generally be within the list already provided in the Background of the invention, or it may belong generally to the group of tools which the skilled person would refer to as a "power tool".

In particular, it is an object of the invention to enable shifting between the configuration when the power tool is in use, i.e. not only during manufacturing of the power tool, but rather to allow dynamically change of the characteristics of the power tool based on the situation in which the power tool is used. The gear ratio is the ratio between the rotational speed (rounds per minute, in the following RPM) of the input shaft relative to the RPM of the output shaft. The input shaft is in the following defined as the shaft from which the gear system receives an input torque e.g. from an electrical motor etc, and the output shaft is the shaft by which the gear system transmits an output torque, e.g. to a tool etc.

The gears may all be made from a synthetic material e.g. plastic, from metal or from any other material known per se for making gear wheels, e.g. by sintering. The toothing could be bevelled or straight, and the number of teeth as well as the pitch circle and other parameters determining the characteristics of the gears may be chosen based on traditional considerations concerning the transferred torque, noise suppression, rotational speeds of the various gears, and a desired gear ratio between each gear in the gear system.

Each set of planet wheels may e.g. contain one, two, three, four or even more individual planet wheels. The rotation of the planet wheels of one set of planet wheels is synchronous with the rotation of planet wheels of the other sets of planet wheels which means that there is a fixed ratio, e.g. 1:1 between the RPM of the gears in the first set and the gears in other sets of planet wheels. The planet wheels could e.g. be synchronised by gear meshes between planet wheels in the first set of planet wheels and planet wheels in the second set of planet wheels, the first set of planet wheels are meshed with one annulus gear and planet wheels in the second set of planet wheels are meshed with another annulus gear thereby establishing a synchronous RPM, or the first set of planet wheels could be in a fixed connection with planet wheels in the second set of planet wheels so that the gears rotate at equal speeds. As an example, the gear may contain one or more gearwheels each forming a gear of the first set of planet wheels and a gear of the second set of planet wheels so that the gears of two sets of gears are formed by a single element.

The planet wheels of one set of planet wheels is joined by a first planet carrier, the planet wheels of another set of planet wheels could be joined by the same planet carrier.

Since the power, i.e. torque, received via the input shaft can be transmitted to the output shaft changeably via changing the state of the planet carrier, a variable gear ratio is obtainable in a simple manner.

The gear system may further comprise a third internally toothed annulus gear and a third set of externally toothed planet wheels being rotatable epicyclically around the central axis synchronously with planet wheels of the first and second sets of planet wheels. The third annulus gear could be meshed with planet wheels of the third set of planet wheels, and in accordance with the previous description of the first and second sets of planet wheels, the rotation of the gears of the third set of planet wheels could be synchronised with the rotation of the other planet wheels by a gear mesh, or by connecting the gears of the third set with gears of the second and optionally gears of the first set of planet wheels, e.g. forming in one body, a gear wheel forming a gear of the first, second and third sets of planet wheels.

The power tool may, particularly, comprise a handle allowing a user of the power tool to shift between the first and the second configuration by manual operation of the handle.

Alternatively, or in combination, the power tool may comprise an automatically operated structure actuating shifting between the first and the second configuration depending on operating conditions of the power tool, e.g. depending on the torque, the RPM, the direction of rotation, the character of the tool attached to the rotor etc.

If the gear system contains three annulus gears, one or two of them may be influenced by the braking means while those who are not affected may serve as input or output.

The sun gear may e.g. be movable relative to the planet wheel between positions wherein the sun gear is meshed with gears of the first set of planet wheels and wherein sun gear may be taken out of meshing with the planet wheels in order to disconnect the input to the gear through the sun gear. This is in particular interesting when the planet carrier is connected to the input, and it is not desirable to have input on both the sun gear and the planet carrier, as this will lock the gear. In one embodiment the sun gear is slideable so it may in one position transfer torque from the input shaft to the planet wheels, and in another position transfer torque directly to planet carrier.

The input shaft may preferably rotate around the centre axis, and as mentioned above, the input shaft may be integral with the sun gear.

Wheels of the first set of planet wheels are preferably meshed with the primary annulus gear and wheels of the second set of planet wheels are preferably meshed with the secondary annulus gear.

In a first embodiment, the gear may have two configurations. The planet carrier may either be locked or partly locked to the frame as a first configuration. In this configuration one of the annulus gears must be considered output and connected to output. The other annulus gear may be free to rotate or it may be possible to interrupt meshing of the other annulus gear with the planet wheels—this is referred to as a released gear. In one embodiment it is a released annulus gear which is used as a locking mechanism to fix the planet carrier in the first configuration. This can be done by sliding the annulus gear back and forth meshing with the planet wheels and the planet carrier, as the annulus gear is locked rotational but moveable to the frame. In this configuration the gear ratio will be low. In a second configuration the planet carrier may be free of rotational limitations by the frame, being free—not connected to any other part, or being connected to the input or output. In this configuration the planet carrier is free rotating, and the first annulus gear is locked or partly locked to the frame. The second annulus gear is connected to the output shaft and the sun gear is meshed with the planet wheels. The sun gear is in addition connected to the input shaft. In this configuration the gear ratio can be made very high.

In a second embodiment the planet carrier is in a first configuration free to rotate, as the first annulus is connected to the frame, or partly fixed to the frame. The second annulus gear is connected to the output and the sun gear is meshed with one set of the planet wheels also being connected or integral with the input shaft. In a second configuration the sun gear is unmeshed with the planet wheels and the planet carrier connected to input shaft.

In a third embodiment the planet carrier is in a first configuration freely rotating, and the first annulus gear is connected to the frame. The second annulus gear is connected to the output shaft, and the sun gear is meshed with one set of the planet wheels. The sun gear is also connected to the input shaft. In a second configuration the second annulus gear is disconnected from the output shaft, and the planet carrier is connected to the output shaft.

The gear system may be connected to another gear system e.g. in a way where the input is driven by the output from another gear system e.g. another planetary gear. The output of the gearbox may in addition be connected to the input of another gearbox. In a second aspect, the invention provides a method for providing shifting between at least a first and a second configuration in a power tool comprising a frame, a motor, a rotor which can be rotated relative to the frame by the motor and which can manipulate a tool, and a transmission including a planetary gear for transmitting power between the motor and the rotor, the method comprising allowing locking of the planet carrier at least partly to the frame to prevent or limit rotation of the planet carrier and thereby form a first configuration and allowing releasing of the planet carrier from rotational limitations of the frame to form a second configuration.

The method may generally apply to a power tool with any of the features mentioned with regards to the first aspect of the invention.

BRIEF DESCRIPTION OF THE DRAWINGS

Embodiments of the invention will now be described in further details with reference to the drawings in which.

DETAILED DESCRIPTION

Figure 1A:
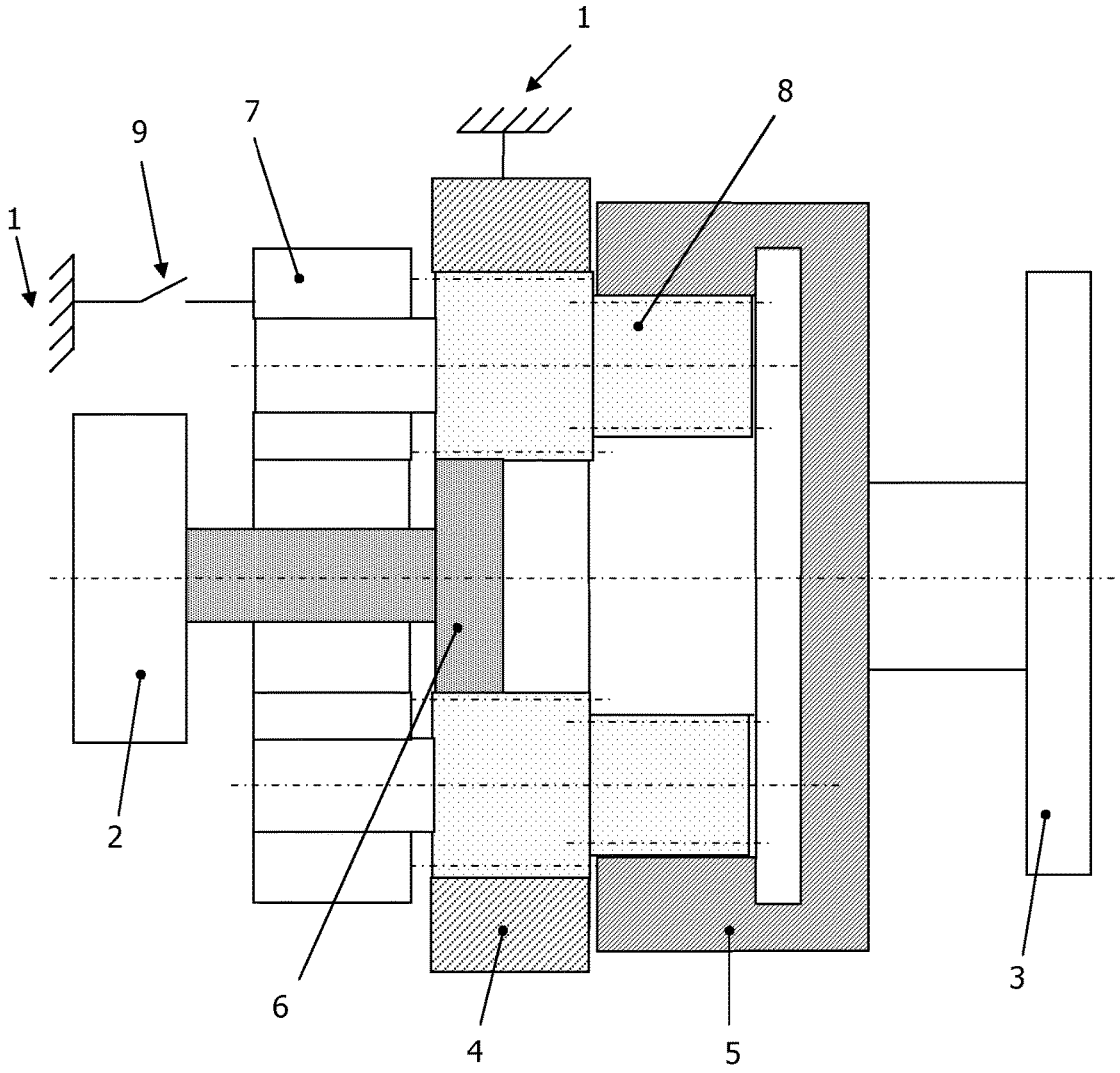
FIGS. 1A and 1B show an embodiment of a gear for a power tool according to the invention.

It should be understood that the detailed description and specific examples, while indicating embodiments of the invention, are given by way of illustration only, since various changes and modifications within the spirit and scope of the invention will become apparent to those skilled in the art from this detailed description.

The power tool comprises a frame 1, a motor 2, and a rotor 3 which can be rotated relative to the frame 1 by the motor 2 and which can manipulate a tool. Furthermore, the power tool comprises a transmission for transmitting power between the motor 2 and the rotor 3. The transmission comprises at least two internally driven annulus gears, a primary 4 and a secondary 5, an externally driven sun gear 6, a planet carrier 7, and at least one planet wheel 8 carried by the planet carrier and arranged to transfer torque between the sun gear and one of the annulus gears.

Each annulus gear, the sun gear and the planet carrier can rotate concentrically around a central axis. Furthermore, each planet wheel can rotate epicyclically around the central axis, and each planet wheel comprises at least two concentrically joined gear wheels.

The power tool comprises a configuration change structure 9 which allows shifting between at least a first configuration (shown in FIG. 1A) and a second configuration (shown in FIG. 1B) depending on the operation of the power tool. The planet carrier is locked rotationally or partly locked rotationally to the frame in the first configuration whereas the planet carrier is released from rotational limitations of the frame in the second configuration.

In FIG. 1A the planet carrier 7 is unlocked and consequently the system can rotate freely as the power tool converts input power on the sun gear 6 to the one of the annulus gears connected to the rotor 3. In FIG. 1A the annulus gear 4 is locked to the system frame and the annulus gear 5 is connected to the rotor of the power tool. Thus, the gearbox has a conversion ratio depending on the pitch diameters of the different gear wheels.

Figure 1B:
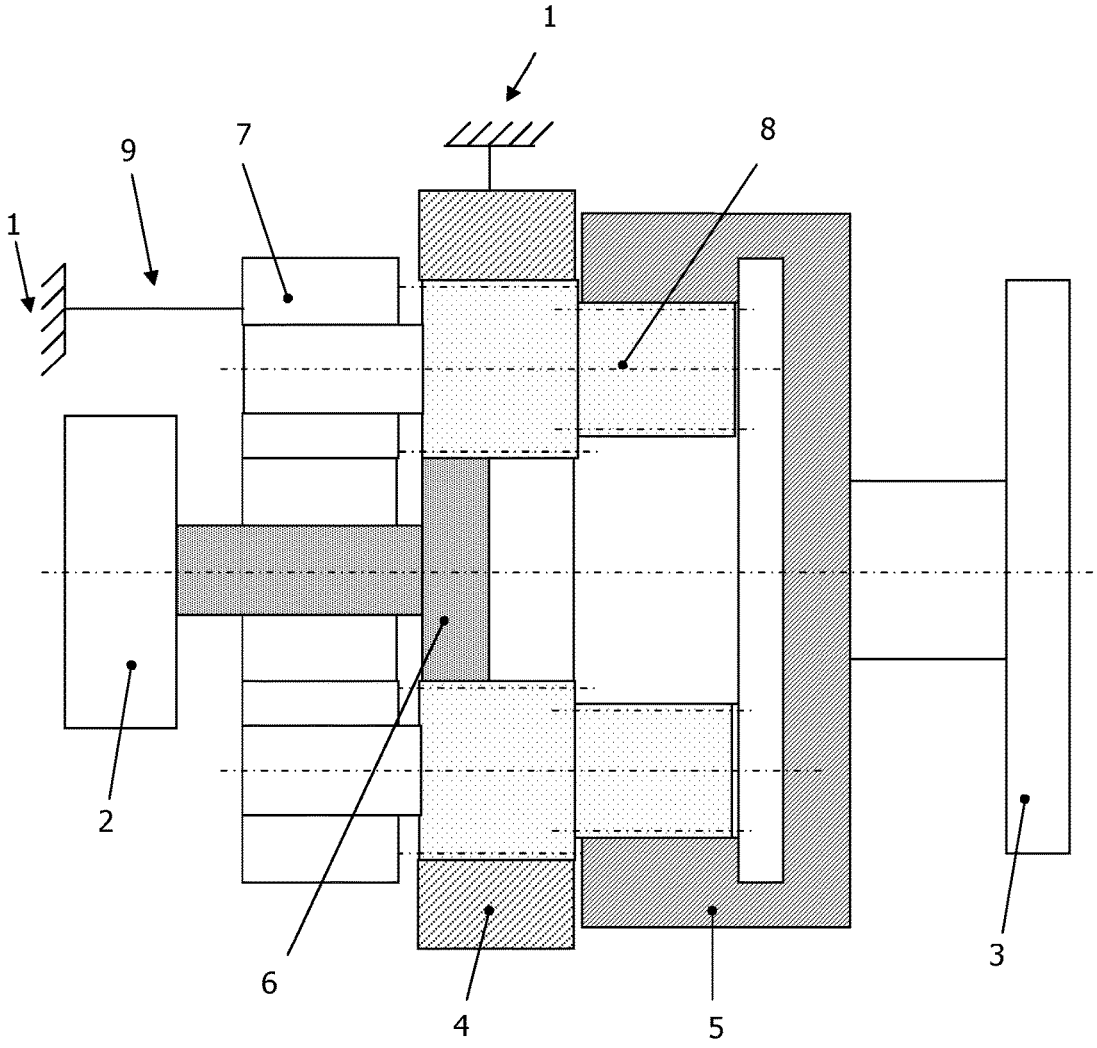

In FIG. 1B the planet carrier is locked to the frame 1 of the system through the configuration change structure (locking mechanism or coupling) 9. The carrier may be locked either partly or fully depending on the actual application. As an example, the degree of locking may depend on a preset torque value on the input, on the output, or on the annulus gear 4 if this is locked to the frame. Thus, the gearbox is locked or partly locked and cannot rotate at least during certain conditions of usage.

In one embodiment, the carrier 7 may be connected to the frame 1, e.g. by a ratchet that prevents the carrier from rotating in one direction. Thus, the ratchet may be adapted to allow the carrier to rotate freely in one configuration at least for a preferred direction of rotation, and may lock the carrier from rotating in the other configuration. The ratchet thereby forms part of the configuration change structure 9.

The ratchet 9 is very helpful during at least one situation related to the use of a power tool, especially a power drill. During screwing of large diameter screws it is often seen that power drills cannot deliver the needed torque to fulfil mounting of large diameter screws. Often the worker finishes the screwing by keeping the motor 2 at stall—'locking the rotor'—and turning the power drill by hand in order to add more torque to the screw.

This is only possible to a certain limit of torque, above which the turning of the power drill will only reverse the motor as the stall torque of the motor will not be enough to prevent reversing of the motor 2. In general, this way of adding more torque is very undesirable. Firstly, giving the motor full current without turning the motor is extremely power consuming, and the real work is done by the worker, and not the motor.

Secondly, there is a significant heating of the motor 2 during this operation, as the cooling blower is not turning, which in some cases has lead to motor damage and reduced lifetime on the motor. Thirdly, the battery is often overstressed by such operation of the power tool, and the loss of energy in the battery is significant.

Introduction of the ratchet 9 or another kind of locking device or configuration change structure—e.g. a structure which is triggered by a torque being transferred by the transmission such that a torque above a specific limit value triggers a configuration change, may prevent the carrier 7 from reversing during special operations. Furthermore, it will be possible to extent the use of e.g. a power drill—enabling the worker to use the power drill as a manual screwdriver during special operations. The ratchet 9 or configuration change structure may have the ability to shift direction of locking whenever the power drill is set to change the direction of rotation. This may easily be done as most power drills already have a changer for direction of rotation.

In other embodiments, locking of the carrier is done electromechanically or mechanically e.g. by mechanisms coupled to the annulus gear 4, This may e.g. be done by allowing the annulus gear 4 to rotate when it transfers a torque above a specific limit. The locking may also be done manually by the user during special operations.

In other embodiments, the locking or shifting mechanism or configuration change structure 9 may be supplement with another mechanism (not shown) thereby unlocking the annulus gear 4 in a third configuration. Thereby, the configuration change structure 9 may be used to or assist in changing gear ratio of the gearbox.

Figure 2A:
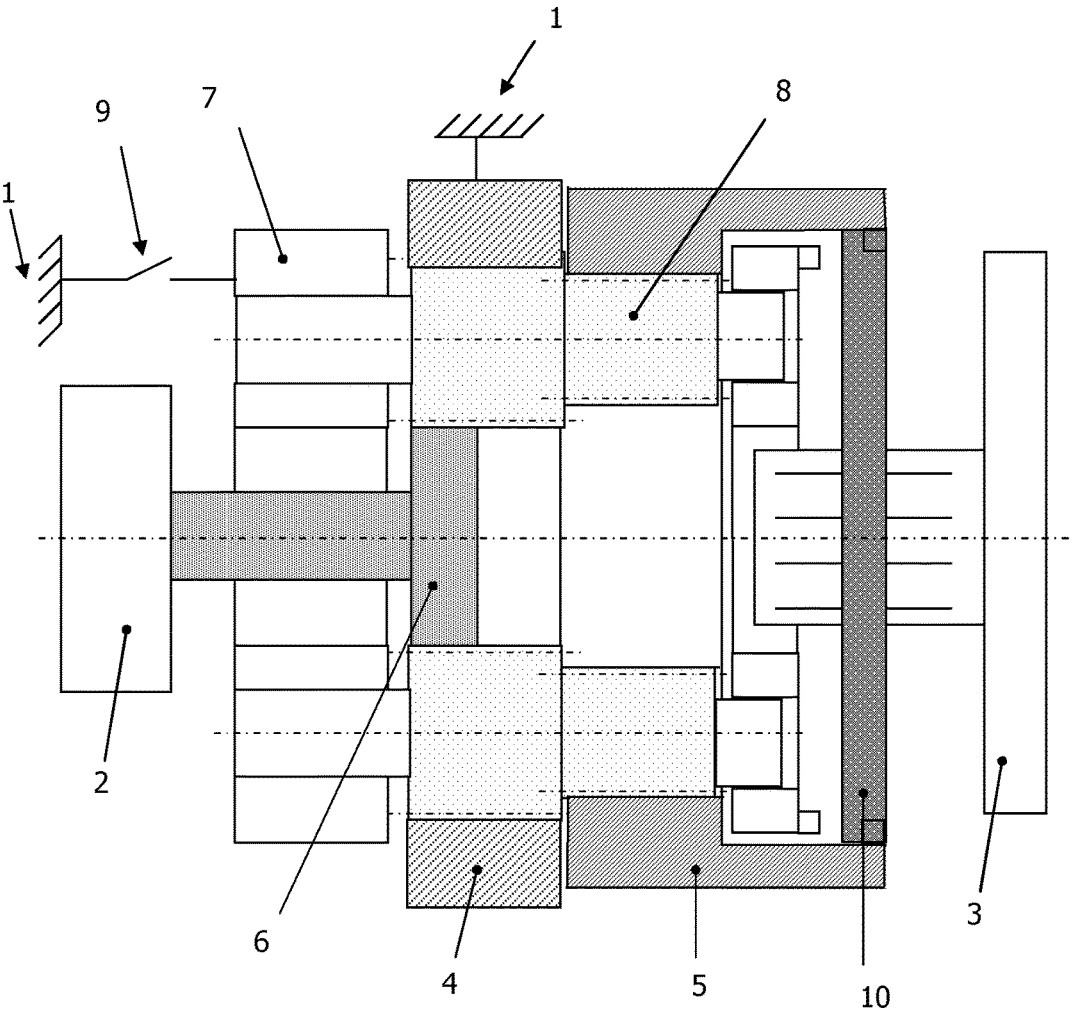
FIGS. 2A and 2B show an alternative embodiment.
Figure 2B:
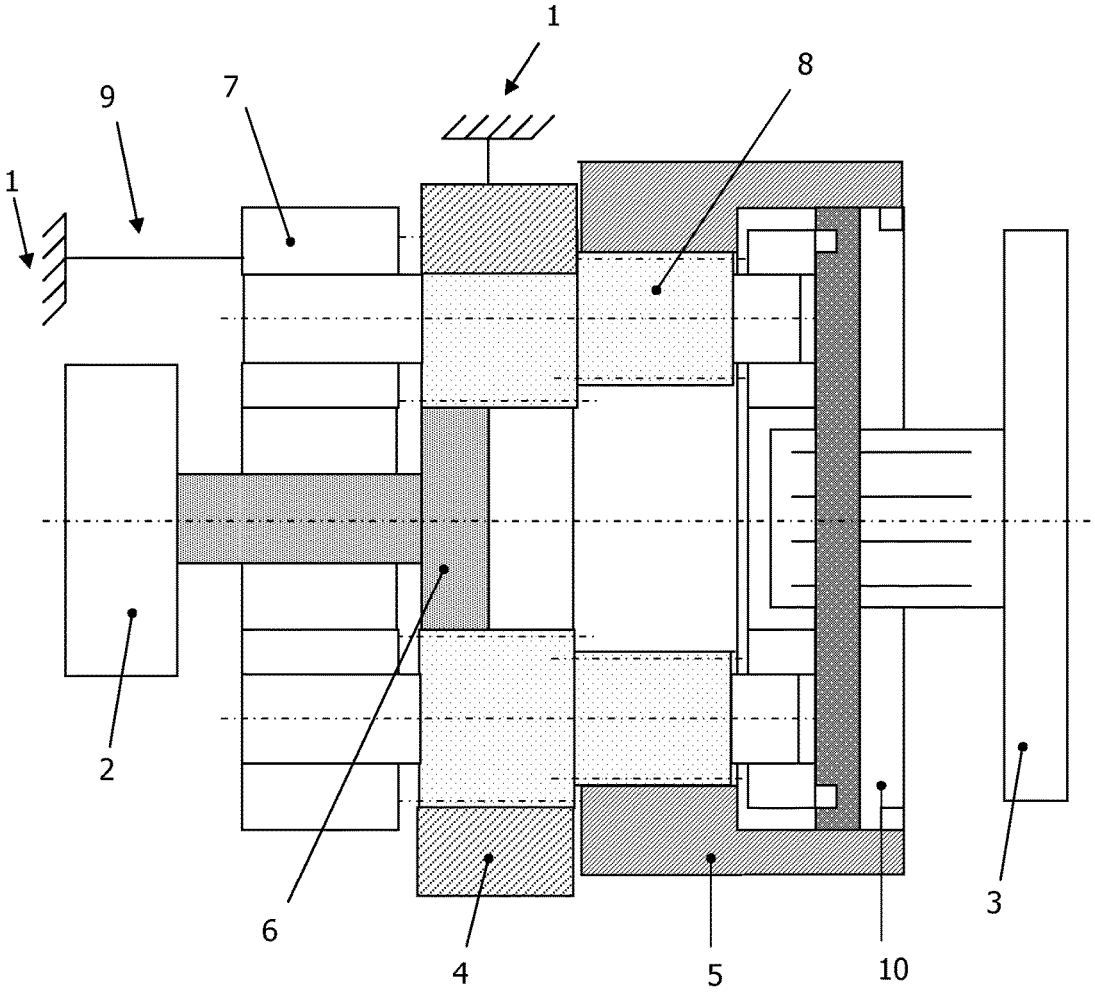

In FIGS. 2A and 2B another preferred embodiment according to invention is shown. The embodiment shows in particular a situation in which the carrier 7 is connected to the rotor 3 in the second configuration. This gives the gearbox two gear ratios depending on which of the annulus gear 5 or carrier 7 is locked to the rotor 3 through the gear change element 10.

As in the embodiment shown in FIG. 1, the gear has a configuration change structure 9, that allows for locking of the carrier 7 in the first configuration. In the second configuration, the carrier 7 is not locked to the frame 1, as the gear ratio is much lower in the second configuration, and it is expected that the locking of the carrier is only relevant with respect to very high output torques. In that case it is obvious to shift gear ratio to a higher gear ratio providing a much higher output torque of the power drill before e.g. the ratchet 9 starts to work. Further, the gear ratio provided by the gearbox in the first configuration will decrease the torque needed to lock the carrier for a sudden torque on the rotor 3. This is not the case if the rotor is connected to the carrier directly. Thus, it is not relevant to lock the carrier in the second configuration.

In addition the configuration change structure 9 may be part of another gear ratio change system where the annulus gear 4 is locked and unlocked in the first configuration in order to provide a third gear ratio of the gear system.

In general there may be other combinations and application of the gearbox described. Thus, the description above may not have full extent, but merely work as examples of embodiment related to the invention. Consequently, there may be other embodiments where the sun gear is integral with motor shaft. Alternative embodiments include configurations where the sun gear is locked to the carrier in the second configuration in order to provide another gear ratio of the gearbox.

The annulus gears 4, 5 may also be connected to different parts of the gearbox in order to create other gear ratios during usage. As such the annulus gear 4, 5 may be connected to the rotor 3 in the second configuration instead of being locked to the frame 1, which may lead to other gear ratios.

In embodiments where the annulus gears 4, 5 are free running during the first or the second configuration, the annulus gears may be taken out of meshing with the planet wheel 8 to reduce friction and noise. In one particular embodiment, the annulus gear 4 may also be used to lock or partly lock the carrier to the frame 1.

Figure 3A:
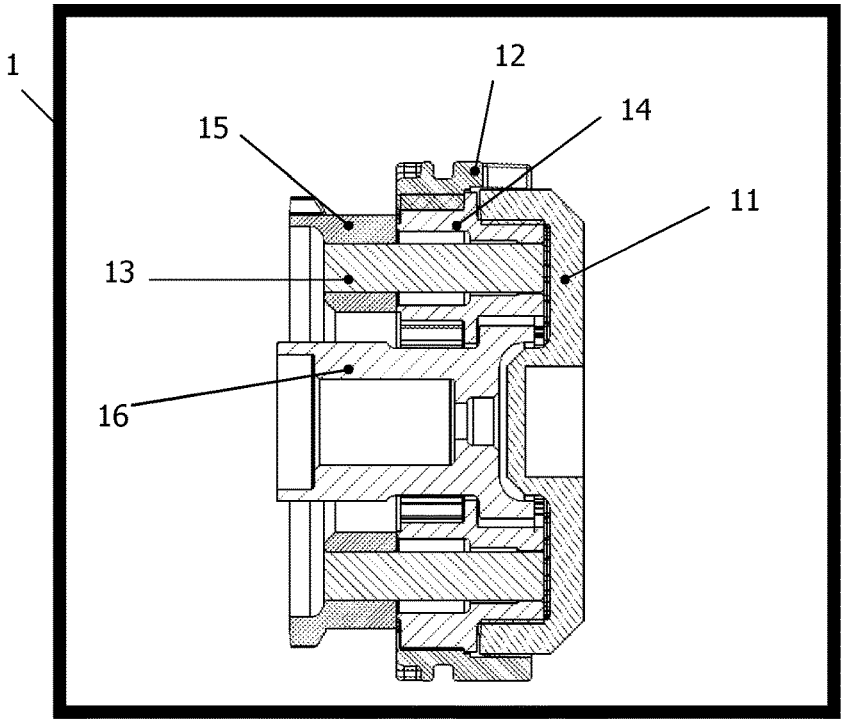
FIGS. 3A and 3B show a further alternative.
Figure 3B:
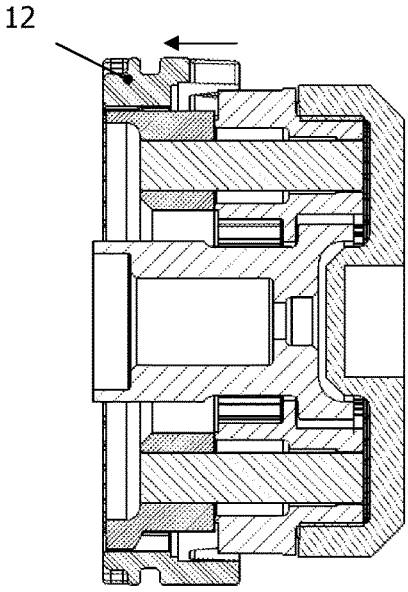

In FIG. 3A a gearbox is shown in a configuration—second configuration—where the planet carrier 15 is running freely without being restricted or limited in its rotation. The one annulus gear 11 represents the output of the gearbox—connected to the rotor not shown. Further this annulus is meshed with the one section of the planet wheel 14. The other annulus 12 is connected to the frame 1 where it is locked for rotation with respect to the frame, and is further meshed with another section of the planet wheel 14. The planet wheels 14 are fixed rotational to a pin 13 working as a bearing, and the pin 13 is further fixed to the planet carrier 15. The system is driven by a sun gear 16 which may be connected to a motor or may be connected to another gearbox, e.g. the output of this. FIG. 3B shows the gearbox in the first configuration, with the planet carrier locked to the frame. As an example this may be done by moving one of the annulus gears—preferred the one not working as output 12. As this annulus gear slides sideways, it will eventually get out of meshing with the planet wheel 14. At the same time, i.e. about the time where it gets out of meshing, the annulus gear will start to intersect with the planet carrier 15. As the annulus gear 12 is locked rotational—consequently the planet carrier will be locked rotational to frame. In the first configuration the planet wheel 14 will no longer mesh with the annulus gear 12 now used to limit the rotation of the planet carrier. Thus the gearbox may rotate with another gear ratio.

In another embodiment one may just use some kind of electronic solenoid or a simple mechanical slider to lock and unlock the annulus gear 12 from the frame 1 and the planet carrier 15.

In FIG. 3B, the annulus gear 12 is referred to as being locked to the frame. In one or both positions of the annulus gear 12 it may be connected to a system allowing the annulus gear 12 to rotate—given certain limitations e.g. allowing the annulus gear 12 to rotate whenever the torque on the annulus gear 12 is exceeding a limit.

What is claimed is:

1. A power tool comprising:

a frame;

a motor;

a rotor rotatable relative to the frame by the motor and capable of manipulating a tool;

a transmission for transmitting power between the motor and the rotor, the transmission comprising:

at least two internally driven annulus gears, including a primary annulus gear and a secondary annulus gear, an externally driven sun gear, a planet carrier, and at least one planet wheel carried by the planet carrier and arranged to transfer torque between the sun gear and one of the annulus gears; wherein each annulus gear, the sun gear and the planet carrier are rotatable concentrically around a central axis, each planet wheel rotatable epicyclically around the central axis, and each planet wheel comprising at least two concentrically joined gear wheels; and a gear change structure allowing shifting between at least a first and a second configuration, the planet carrier being locked rotationally or partly locked rotationally to the frame in the first configuration and the planet carrier being released from rotational limitations of the frame in the second configuration.

2. The tool as recited in claim 1 wherein the planet carrier is connected to the rotor in the second configuration.

3. The tool as recited in claim 1 wherein the planet carrier is connected to the motor in the second configuration.

4. The tool as recited in claim 1 wherein the sun gear is connected to the motor in the first or second configuration.

5. The tool as recited in claim 1 wherein the sun gear is connected to the rotor in the second configuration.

6. The tool as recited in claim 1 wherein at least one of the annulus gears is connected to the rotor in the second configuration.

7. The tool as recited in claim 1 wherein at least one of the annulus gears is free running in the first configuration.

8. The tool as recited in claim 1 wherein at least one of the annulus gears is connected to the frame in the second configuration.

9. The tool as recited in claim 1 wherein the at least one of the annulus gears is not meshed with the planet wheels in the first configuration.

10. The tool as recited in claim 1 wherein the at least one of the annulus gears is not meshed with the planet wheels in the second configuration.

11. The tool as recited in claim 1 wherein one of the annulus gears not meshed with the planet wheels is used to shift the configuration of the carrier by shifting between connection of the one annulus gear to the frame or to the planet carrier and connection of the one annulus gear to the planet carrier or the rotor.

12. The tool as recited in claim 1 wherein the power tool shifts between the first and the second configuration by manual operation.

13. The tool as recited in claim 1 wherein shifting between the first and the second configuration occurs automatically depending on operating conditions of the power tool.

14. The tool as recited in claim 1 wherein at least one of the annulus gears or the planet carrier is connected to the frame to permit partial rotation relative to the frame during a specified load.

15. The tool as recited in claim 14 wherein the specified load is whenever a specific torque acts on the planet carrier or annulus gears is reached.

* * * * *